US010876793B2

(12) United States Patent
Yamashita

(10) Patent No.: US 10,876,793 B2
(45) Date of Patent: Dec. 29, 2020

(54) HEATING FURNACE HAVING DOUBLE INSULATING WALL STRUCTURE

(71) Applicant: TOYOTA JIDOSHA KABUSHIKI KAISHA, Toyota (JP)

(72) Inventor: Osamu Yamashita, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 129 days.

(21) Appl. No.: 16/004,522

(22) Filed: Jun. 11, 2018

(65) Prior Publication Data

US 2019/0033000 A1 Jan. 31, 2019

(30) Foreign Application Priority Data

Jul. 25, 2017 (JP) ..... 2017-143492

(51) Int. Cl.
*F27D 1/00* (2006.01)
*F27D 11/00* (2006.01)

(52) U.S. Cl.
CPC ..... *F27D 1/0033* (2013.01); *F27D 1/0006* (2013.01); *F27D 1/0023* (2013.01); *F27D 1/0026* (2013.01); *F27D 1/0036* (2013.01); *F27D 11/00* (2013.01); *F27D 2001/0063* (2013.01); *F27D 2001/0073* (2013.01)

(58) Field of Classification Search
CPC ..... F27D 1/16; F27D 1/0023; F27D 1/0026; B65D 9/26; B65D 81/3818; B65D 81/3881; F16L 9/147; F16L 9/133; F16L 9/047; F16L 9/085; F16L 9/128; F16L 11/08; F16L 11/112
See application file for complete search history.

(56) References Cited

U.S. PATENT DOCUMENTS 1,672,904 A * 6/1928 Randall ..... B65D 81/3818 220/592.27
3,595,275 A * 7/1971 Steans ..... F16L 59/125 138/114
4,570,678 A * 2/1986 Ziemek ..... F16L 59/065 138/113
4,598,857 A * 7/1986 Matsui ..... B23K 20/001 156/86
4,770,630 A 9/1988 Akimoto et al.
(Continued)

FOREIGN PATENT DOCUMENTS

JP 06-189861 A 7/1994
JP 2003269866 A 9/2003
(Continued)

*Primary Examiner* — Gregory A Wilson
(74) *Attorney, Agent, or Firm* — Sughrue Mion, PLLC

(57) ABSTRACT

A double insulating wall structure heating furnace capable of preventing its inner pipe whose strength has decreased due to high-temperature heating from being damaged. A double insulating wall structure heating furnace 1 includes an outer pipe 2 and an inner pipe 3 disposed inside the outer pipe 2, in which a sealed space 8 formed between the outer and inner pipes 2 and 3 is depressurized and a heating space 13 formed inside the inner pipe 3 is heated, and in which a tubular reinforcing member 6 is disposed so as to cover an outer circumference of the inner pipe 3, the tubular reinforcing member being formed of a material having a higher heat resistance and a higher strength than those of the material of the inner pipe 3.

3 Claims, 7 Drawing Sheets

(56) References Cited

U.S. PATENT DOCUMENTS

| | | | | |
|---|---|---|---|---|
| 5,134,261 | A * | 7/1992 | Larkin | F27B 14/06 117/223 |
| 5,416,795 | A * | 5/1995 | Kaniuk | F27B 14/10 264/618 |
| 5,588,197 | A | 12/1996 | Satomi et al. | |
| 6,440,220 | B1 * | 8/2002 | Rudolph | C23C 16/045 118/723 AN |
| 6,616,756 | B2 * | 9/2003 | Thebault | C30B 15/10 117/13 |
| 7,226,243 | B2 * | 6/2007 | Lee | F16L 59/143 405/154.1 |
| 9,353,893 | B2 * | 5/2016 | Ruby | F16L 57/06 |
| 2002/0008113 | A1 * | 1/2002 | Fujii | B65D 81/3818 220/592.2 |
| 2009/0000681 | A1 * | 1/2009 | Averbuch | F16L 9/042 138/112 |
| 2010/0193062 | A1 * | 8/2010 | Buckley | F16L 9/04 138/114 |
| 2014/0216485 | A1 | 8/2014 | Egoyants et al. | |
| 2015/0354897 | A1 * | 12/2015 | Sachs | F27B 14/10 65/24 |
| 2016/0362240 | A1 * | 12/2016 | Ferracamo, Jr. | A61J 1/165 |
| 2018/0112812 | A1 * | 4/2018 | Takahashi | F27B 5/08 |

FOREIGN PATENT DOCUMENTS

| | | | |
|---|---|---|---|
| JP | 2014-518367 | A | 7/2014 |
| WO | 2013/034455 | A1 | 3/2013 |

* cited by examiner

HEATING FURNACE HAVING DOUBLE INSULATING WALL STRUCTURE

CROSS REFERENCE TO RELATED APPLICATIONS

This application is based upon and claims the benefit of priority from Japanese patent application No. 2017-143492, filed on Jul. 25, 2017, the disclosure of which is incorporated herein in its entirety by reference.

BACKGROUND

The present disclosure relates to a heating furnace having a double insulating wall structure.

A vacuum insulating structure in which an inner pipe is disposed inside an outer pipe to form a double pipe, and a mouth of a space formed between the outer and inner pipes is sealed so that a vacuum space is formed between the inner and outer pipes has been known. Japanese Unexamined Patent Application Publication No. H6-189861 discloses a vacuum insulating structure formed of a stainless steel material in which outer and inner pipes are annealed at a low temperature.

SUMMARY

The present inventors have found the following problem. A heating furnace to which the above-described vacuum insulating structure is applied (i.e., a heating furnace having a double insulating wall structure) has been known. That is, in the heating furnace having a double insulating wall structure (hereinafter also referred to as the "double insulating wall structure heating furnace"), a space inside the inner pipe serves as a heating space and the heating space is thermally cut off (i.e., thermally insulated) from the outside by a vacuum space formed between the inner and outer pipes. An object to be heated which is contained inside the inner pipe is heated to a heating temperature by a heating source such as a heater provided inside the inner pipe.

FIG. 7 is a schematic cross section for explaining a double insulating wall structure heating furnace 501 related to a problem to be solved by the present disclosure. Note that a right-handed xyz-coordinate system shown in FIG. 7 is illustrated for the sake of convenience for explaining a positional relation among components. An upper part of FIG. 7 shows the double insulating wall structure heating furnace 501 in an unheated state, and a lower part thereof shows that in a heated state.

As shown in FIG. 7, the double insulating wall structure heating furnace 501 includes an outer pipe 502 and an inner pipe 503. The inner pipe 503 is disposed inside the outer pipe 502. The outer and inner pipes 502 and 503 are made of a metallic material such as stainless steel. The inner and outer pipes 503 and 502 are connected to each other at both ends thereof with bellows 505 interposed therebetween. Further, a sealed space 508 is formed between the outer and inner pipes 502 and 503. The sealed space 508 is a depressurized vacuum space, and the outer and inner pipes 502 and 503 are thermally insulated from each other by this vacuum space. A space formed inside the inner pipe 503 serves as a heating space 513.

When the heating space 513 is heated from the unheated state shown in the upper part of FIG. 7 to a high heating temperature of about 1,000° C. by a heating source 514 such as a heater, the metallic inner pipe 503 thermally expands in the radial and axial directions and softens. Therefore, its strength decreases. Therefore, as shown in the lower part of FIG. 7, there is a possibility that the inner pipe 503 may be damaged by a load mg imposed by an object to be heated W disposed inside the inner pipe 503. Further, since the outer circumference of the inner pipe 503 is in contact with the depressurized sealed space 508, a stress is exerted on the inner pipe 503 in a direction toward the inner circumference of the outer pipe 502. However, if the strength of the inner pipe 503 is decreased due to high-temperature heating, the inner pipe 503 could be damaged by this stress.

The present disclosure has been made in view of the above-described circumstances and an object thereof is to provide a double insulating wall structure heating furnace capable of preventing its inner pipe whose strength has decreased due to high-temperature heating from being damaged.

A first exemplary aspect is a double insulating wall structure heating furnace includes an outer pipe and an inner pipe disposed inside the outer pipe, in which a sealed space formed between the outer and inner pipes is depressurized and a space formed inside the inner pipe is heated to a heating temperature, and in which a tubular reinforcing member is disposed so as to cover an outer circumference of the inner pipe, the tubular reinforcing member being formed of a material that has a higher strength than that of a material of the inner pipe at the heating temperature.

When the inner pipe of the double insulating wall structure heating furnace is heated to a high heating temperature of about 1,000° C., the inner pipe thermally expands in the radial and axial directions and softens. Therefore, its strength decreases. Since the tubular reinforcing member, which is formed of a material that has a higher strength than that of the material of the inner pipe at the heating temperature, is disposed so as to cover an outer circumference of the inner pipe, the inner pipe, which is heated to a high temperature and hence has a reduced strength, is well reinforced by the reinforcing member. In this way, it is possible to prevent the inner pipe from being damaged due to a load imposed by an object such as an object to be heated disposed inside the inner pipe. Further, since the outer circumference of the inner pipe is in contact with the depressurized sealed space, a stress is exerted on the inner pipe in a direction toward the inner circumference of the outer pipe. However, thermal expansion of the inner pipe in the radial direction is regulated (i.e., restricted) by the reinforcement member covering the outer circumference of the inner pipe. As a result, it is possible to prevent the inner pipe, which is heated to a high temperature, from being damaged by the stress.

Further, the reinforcing member may be configured so that its inner diameter is larger than an outer diameter of the inner pipe in an unheated state and its inner diameter is substantially equal to the outer diameter of the inner pipe at the heating temperature. A coefficient of thermal expansion of the inner pipe is larger than that of the reinforcing member. By configuring the reinforcing member so that its inner diameter is larger than the outer diameter of the inner pipe in the unheated state and its inner diameter is substantially equal to the outer diameter of the inner pipe at the heating temperature, the inner pipe, whose strength has decreased due to the high-temperature heating, is well reinforced by the reinforcing member without being warped.

Further, the material of the reinforcing member may contain graphite. Graphite is a material having a high heat resistance and a high strength, and is inexpensive. Therefore, graphite is preferable as a material for the reinforcing member.

Further, a thin film made of ceramic may be provided between the inner pipe and the reinforcing member. In the case where the reinforcing member is made of a material containing graphite or a carbon-containing material such as a carbon fiber reinforced carbon composite material, it is possible to prevent the metallic inner pipe and the reinforcing member from coming into contact with each other and thereby prevent the metallic inner pipe from being carburized during the high-temperature heating by inserting a ceramic thin film between the outer circumferential surface of the inner pipe and the inner circumferential surface of the reinforcing member.

According to the present disclosure, it is possible to prevent the inner pipe, whose strength has decreased due to high-temperature heating, from being damaged.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Embodiments according to the present disclosure are described hereinafter with reference to the drawings. For clarifying the explanation, the following description and the drawings are partially omitted and simplified as appropriate. The same symbols are assigned to the same elements throughout the drawings and duplicated explanations are omitted as appropriate.

First Embodiment

A first embodiment according to the present disclosure is described hereinafter with reference to the drawings.

Firstly, a configuration of a double insulating wall structure heating furnace according to the first embodiment is described with reference to FIGS. 1 and 2.

Figure 1:
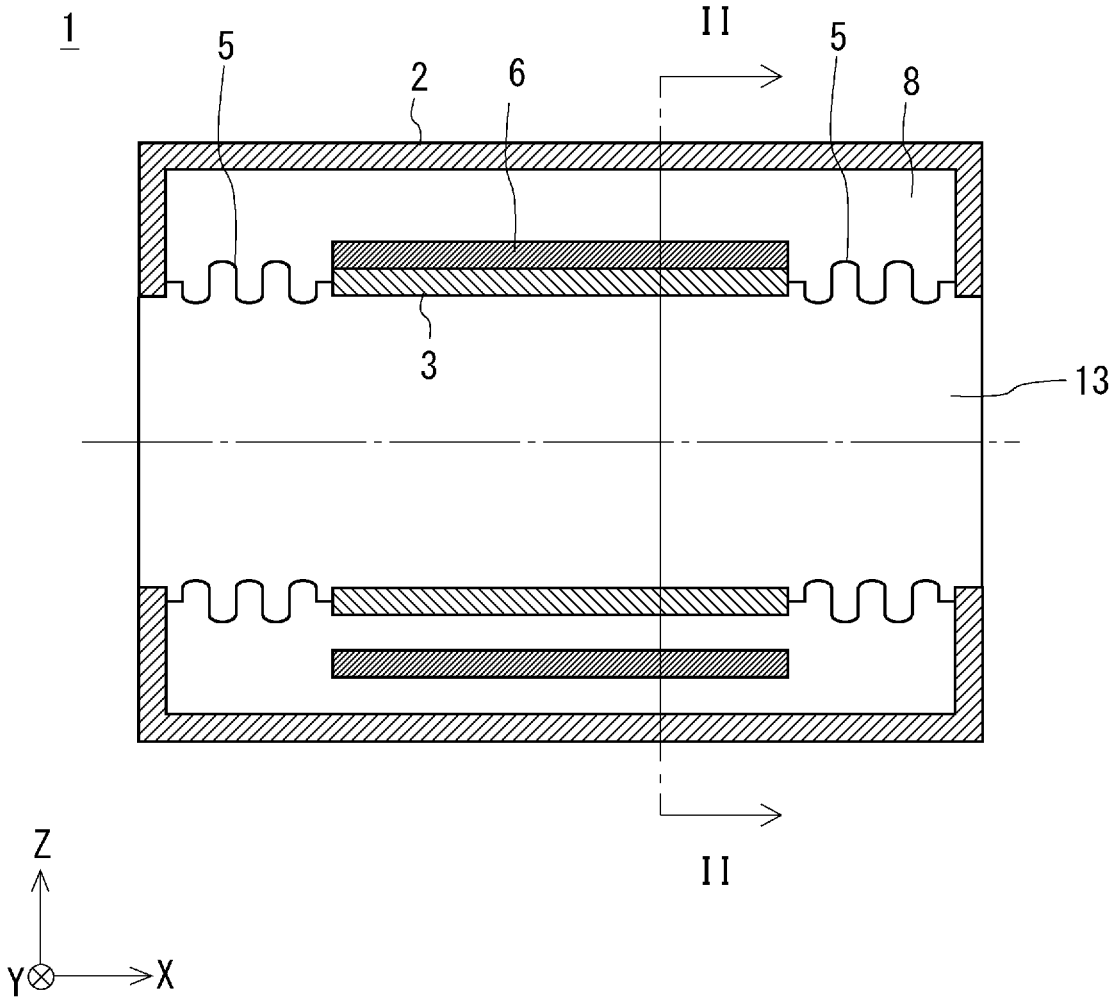
FIG. 1 is a schematic diagram for explaining a configuration of a double insulating wall structure heating furnace according to a first embodiment.
Figure 2:
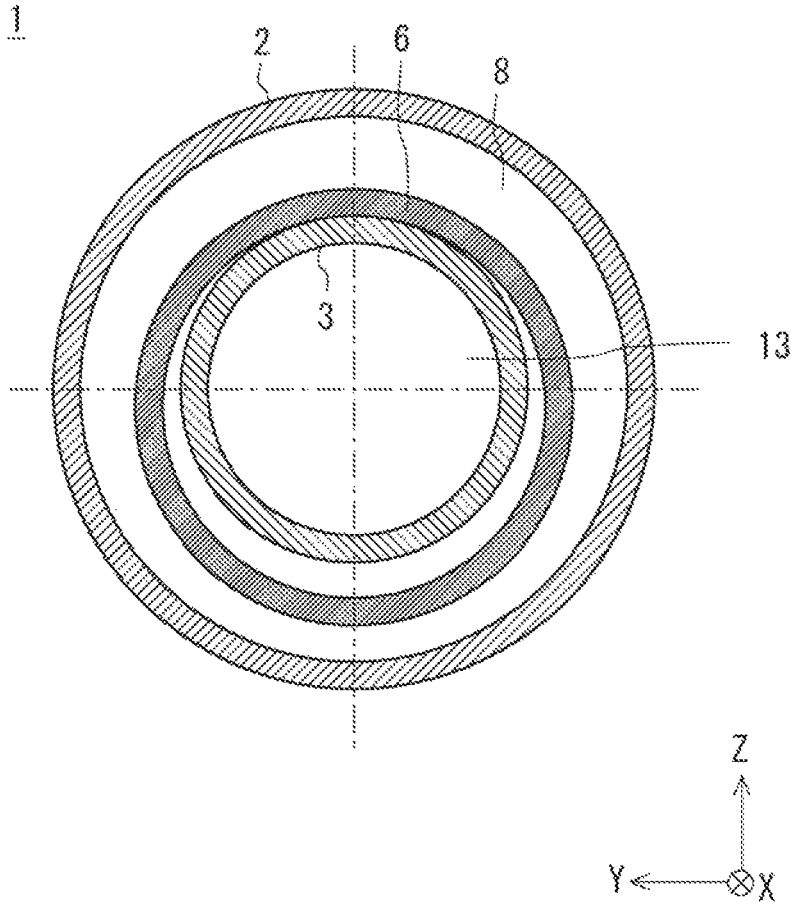
FIG. 2 is a cross section taken along a line II-II in FIG. 1.

FIG. 1 is a schematic diagram for explaining a configuration of a double insulating wall structure heating furnace 1. FIG. 2 is a cross section taken along a line II-II in FIG. 1. As shown in FIGS. 1 and 2, the double insulating wall structure heating furnace 1 includes an outer pipe 2, an inner pipe 3, and a reinforcing member 6.

The outer pipe 2 and the inner pipe 3 are cylindrical members in which both ends thereof are opened. The inner pipe 3 is disposed inside the outer pipe 2. The material for the outer and inner pipes 2 and 3 is, for example, stainless steel (SUS304, SUS316L, etc.) or steel. At both of the ends of the outer pipe 2, ring-shaped walls that inwardly extend along the opening planes of the outer pipe 2 are formed. A bellows 5 is connected to each end of the inner pipe 3 in the axial direction. The other ends of the bellows 5, i.e., the ends opposite to the ends connected to the inner pipe 3 are connected to the ring-shaped walls of the outer pipe 2. That is, the inner and outer piped 3 and 2 are connected to each other at both ends with the bellows 5 interposed therebetween. As a result, a sealed space 8 is formed between the outer and inner pipes 2 and 3. Since the bellows 5 form flexible and extendable pipes and function as elastic members, they can absorb a deformation of the inner pipe 3 caused by thermal expansion thereof. The material for the bellows 5 is, for example, stainless steel, steel, titanium, or the like.

The sealed space 8 is a depressurized vacuum space. That is, the sealed space 8 is evacuated by a vacuum pump or the like and maintained in a vacuum state. In this way, the outer and inner pipes 2 and 3 are thermally insulated from each other by the sealed space 8, which is a vacuum space. The outside of the outer pipe 2 is the outside air. The space inside the inner pipe 3 serves as a heating space 13. That is, the outer circumferential surface of the outer pipe 2 is in contact with the outside air and the inner circumferential surface of the inner pipe 3 is in contact with the heating space 13. The presence of the sealed space 8, which is the vacuum space, between the outer and inner pipes 2 and 3 can prevent heat in the heating space 13 from escaping to the outside air.

The reinforcing member 6 is disposed so as to cover the outer circumference of the inner pipe 3. Note that the expression that the reinforcing member 6 "covers the outer circumference of the inner pipe 3" is not used to limit its meaning to the case where the reinforcing member 6 completely covers the outer circumference of the inner pipe 3. It includes the case where a part of the outer circumference of the inner pipe 3 is exposed from the reinforcing member 6. The reinforcing member 6 has a tubular shape and is formed of a material having a higher heat resistance and a higher strength than those of the material of the inner pipe 3. The reinforcing member 6 is formed of, for example, a material containing graphite, a carbon fiber reinforced carbon composite material (a C/C composite), or a material containing alumina. Note that the carbon fiber reinforced carbon composite material is a carbon composite material that is reinforced by high-strength carbon fibers in order to improve a strength, an impact resistance, and the like of the carbon material.

When the inner pipe 3 of the double insulating wall structure heating furnace 1 is heated to a high heating temperature of about 1,000° C., it thermally expands in the radial and axial directions and softens. Therefore, its strength decreases. Since the tubular reinforcing member 6, which is formed of a material having a higher heat resistance and a higher strength than those of the material of the inner pipe 3, is disposed so as to cover the outer circumference of the inner pipe 3, the inner pipe 3, which is heated to a high temperature and hence has a reduced strength, is well reinforced by the reinforcing member 6. In this way, it is possible to prevent the inner pipe 3 from being damaged due to a load imposed by an object such as an object to be heated disposed inside the inner pipe 3. Further, since the outer circumference of the inner pipe 3 is in contact with the depressurized sealed space 8, a stress is exerted on the inner pipe 3 in a direction toward the inner circumference of the outer pipe 2. However, thermal expansion of the inner pipe 3 in the radial direction is regulated (i.e., restricted) by the reinforcement member 6 covering the outer circumference of the inner pipe 3. As a result, it is possible to prevent the inner pipe 3, which is heated to a high temperature, from being damaged by the stress.

Next, states of the double insulating wall structure heating furnace 1 according to this embodiment before and after heating in the heating space 13 is carried out are described.

Figure 3:
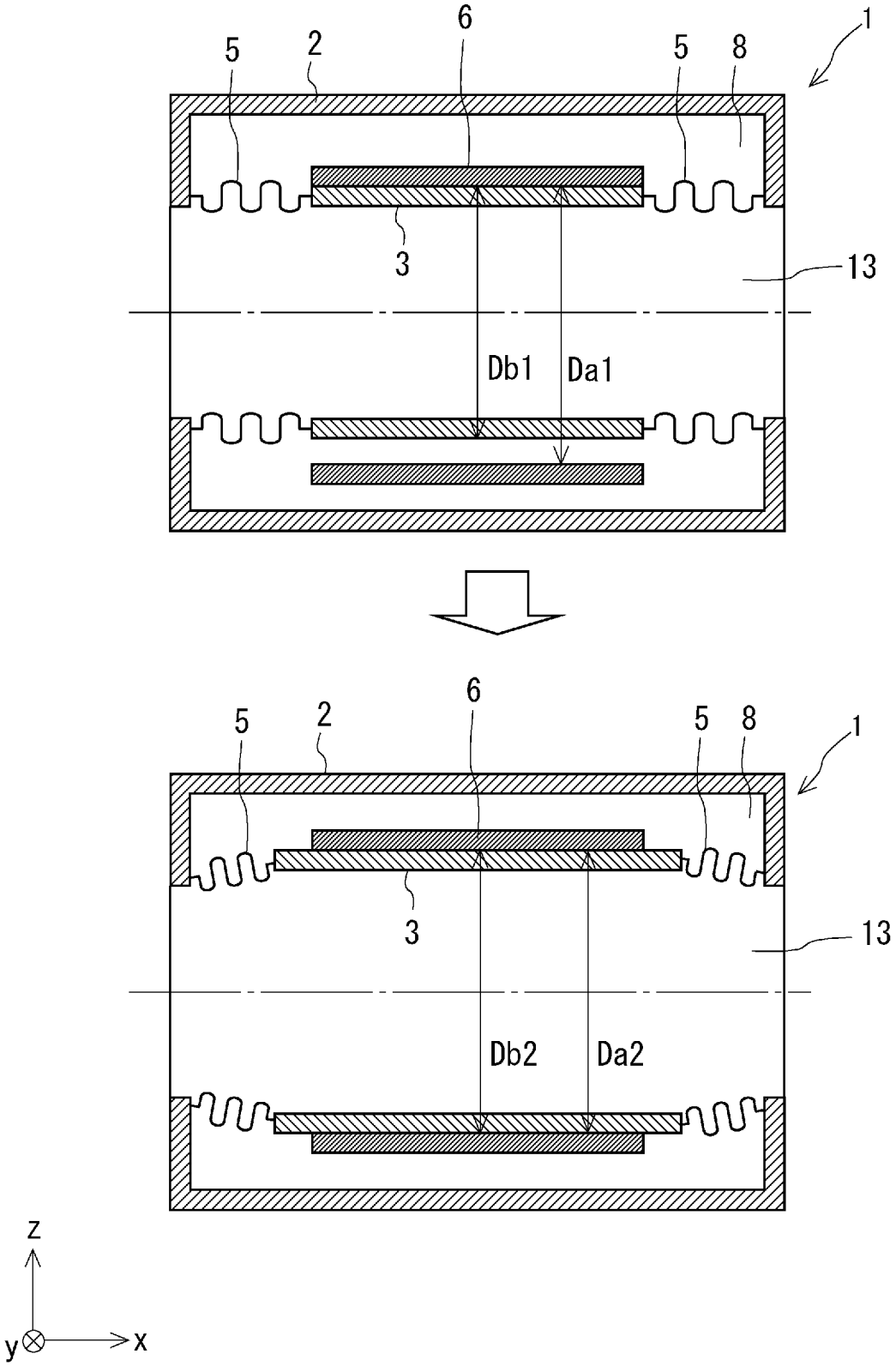
FIG. 3 is a schematic diagram for explaining states of a double insulating wall structure heating furnace according to the first embodiment before and after heating in a heating space is carried out.

FIG. 3 is a schematic diagram for explaining states of the double insulating wall structure heating furnace 1 before and after heating in the heating space 13 is carried out. An upper part of FIG. 3 shows the double insulating wall structure heating furnace 1 in an unheated state, and a lower part thereof shows that in a heated state. Note that the heating state is a state in which the heating space 13 of the double insulating wall structure heating furnace 1 is in a high-temperature heated stated (for example, at about 1,000° C.).

As shown in the upper part of FIG. 3, the reinforcing member 6 of the double insulating wall structure heating furnace 1 is configured so that its inner diameter Da1 is larger than an outer diameter Db1 of the inner pipe 3 in the unheated state. Further, as shown in the lower part of FIG. 3, the reinforcing member 6 of the double insulating wall structure heating furnace 1 is configured so that its inner diameter Da2 becomes substantially equal to an outer diameter Db2 of the inner pipe 3 in the heated state.

The coefficient of thermal expansion of the inner pipe 3 is larger than that of the reinforcing member 6. That is, a difference between the outer diameter Db2 of the inner pipe 3 in the heated state and the outer diameter Db1 of the inner pipe 3 in the unheated state is larger than a difference between the inner diameter Da2 of the reinforcing member 6 in the heated state and the inner diameter Da1 of the reinforcing member 6 in the unheated state.

Assume that, for example, the material of the inner pipe 3 is SUS304 and the material of the reinforcing member 6 is graphite. While the coefficient of linear expansion of SUS304 is about $18\times10^{-6}$/° C., that of graphite is about $5.6\times10^{-6}$/° C. Assuming that the outer diameter Db1 of the inner pipe 3 at a room temperature (20° C.) is 200 cm, when the inner pipe 3 is heated to 1,000° C., the outer diameter Db2 of the inner pipe 3 is 203.5 [cm] (Db2 [cm]=200 [cm]+200 [cm]×(1,000 [° C.]-20 [° C.])×$18\times10^{-6}$ [/° C.]=203.5 [cm]). Then, in order to make the inner diameter Da2 of the reinforcing member 6 become 203.5 cm when it is heated to 1,000° C., the inner diameter Da1 of the reinforcing member 6 at the room temperature (20° C.) may be adjusted to 202.4 cm. (The inner diameter Da1 [cm] of the reinforcing member 6 is calculated as 202.4 cm as follows: 203.5 [cm]=Da1 [cm]+Da1 [cm]×(1,000 [° C.]-20 [° C.])×$5.6\times10^{-6}$ [/° C.]).

By configuring the reinforcing member 6 so that its inner diameter is larger than the outer diameter of the inner pipe 3 in the unheated state and its inner diameter is substantially equal to the outer diameter of the inner pipe 3 at the heating temperature, the inner pipe 3, whose strength has decreased due to the high-temperature heating, is well reinforced by the reinforcing member 6 without being warped.

As described above, according to the double insulating wall structure heating furnace 1 in accordance with this embodiment, it is possible to prevent the inner pipe 3, whose strength has decreased due to high-temperature heating, from being damaged.

Second Embodiment

A second embodiment according to the present disclosure is described hereinafter with reference to the drawings.

Firstly, a configuration of a double insulating wall structure heating furnace according to the second embodiment is described with reference to FIGS. 4 and 5.

Figure 4:
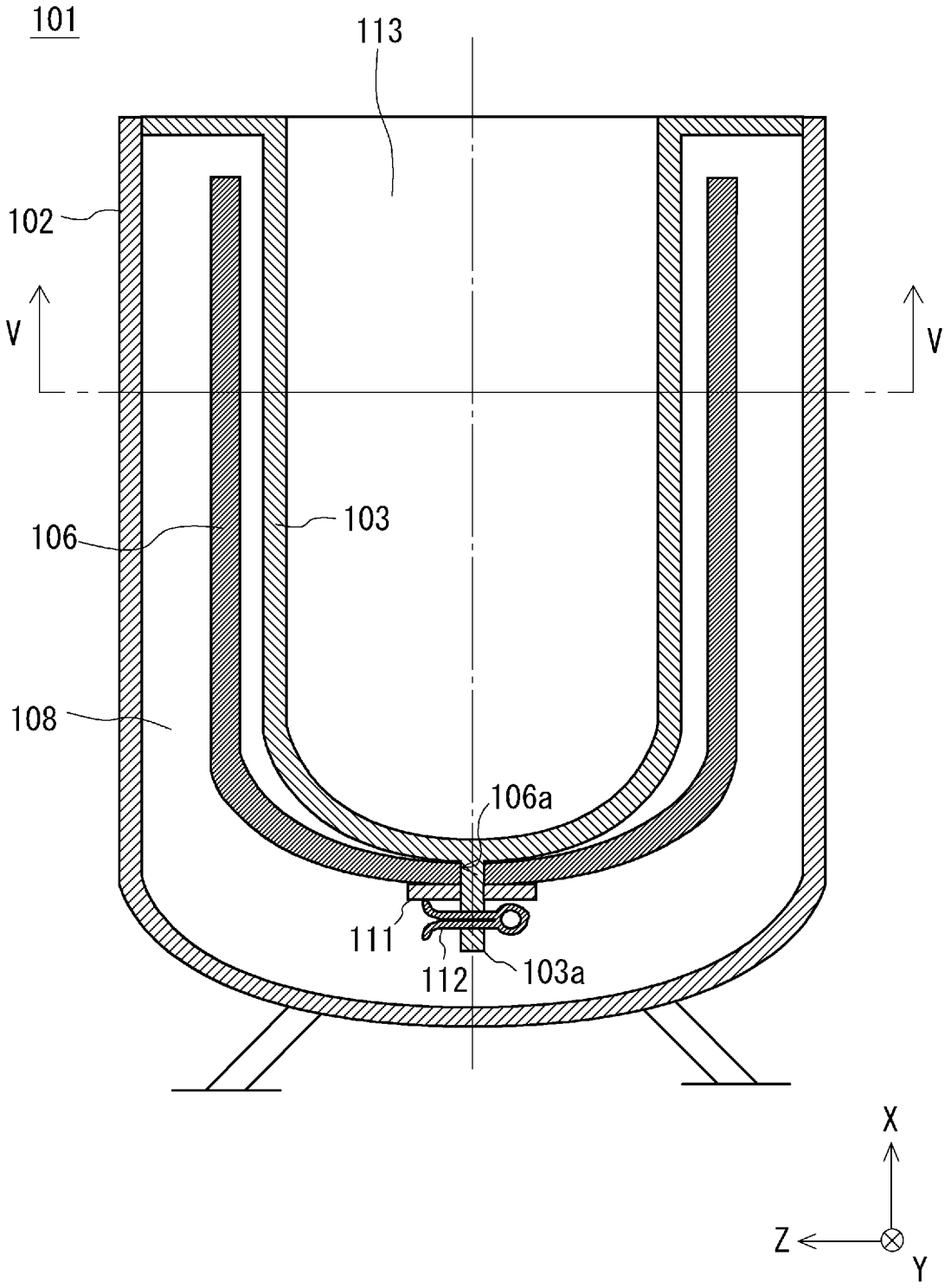
FIG. 4 is a schematic diagram for explaining a configuration of a double insulating wall structure heating furnace (double-walled heating structure heating furnace) according to a second embodiment.
Figure 5:
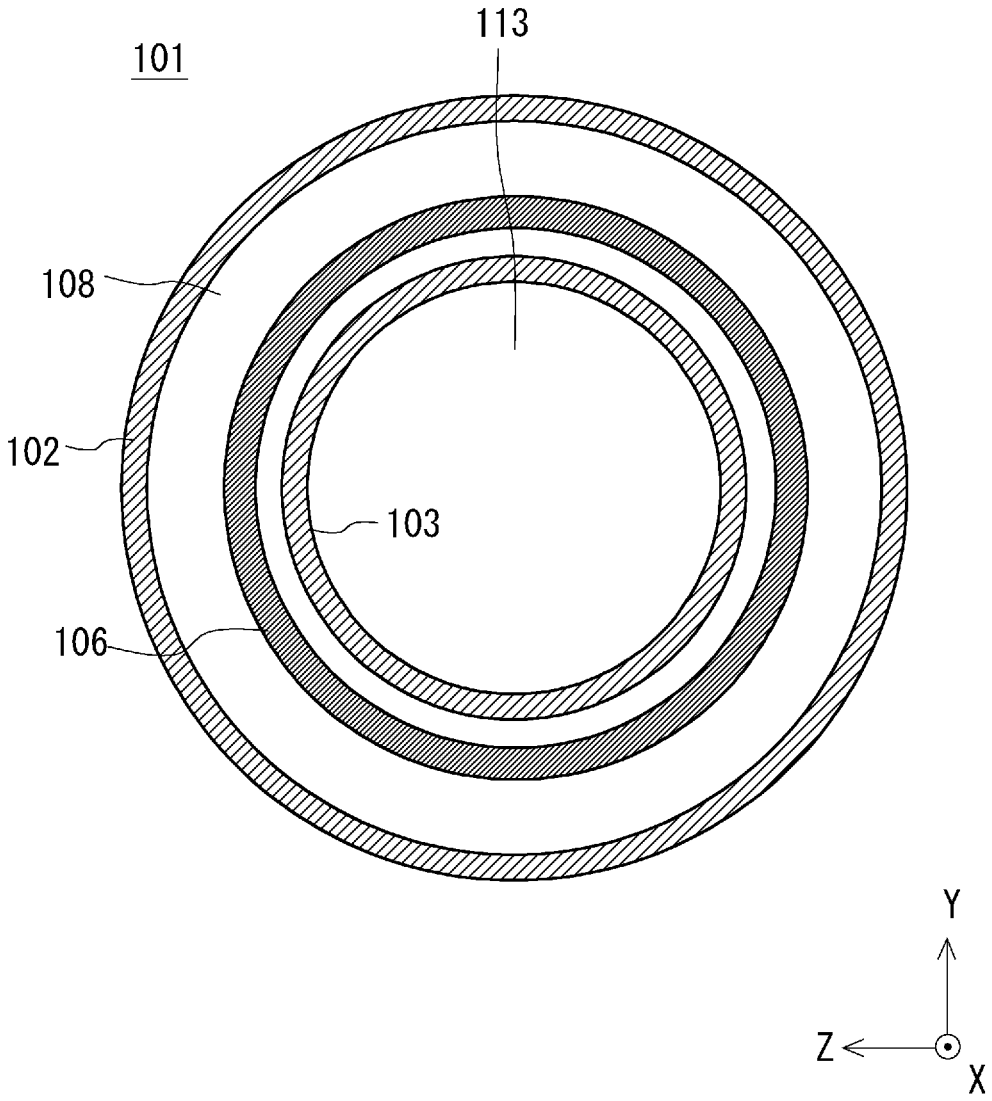
FIG. 5 is a cross section taken along a line V-V in FIG. 4.

FIG. 4 is a schematic diagram for explaining a configuration of a double insulating wall structure heating furnace 101. FIG. 5 is a cross section taken along a line V-V in FIG. 4. As shown in FIGS. 4 and 5, the double insulating wall structure heating furnace 101 includes an outer pipe 102 having a bottom and an inner pipe 103 having a bottom, in which the inner pipe 103 is disposed inside the outer pipe 102.

The material for the outer and inner pipes 102 and 103 is, for example, stainless steel (SUS304, SUS316L, etc.) or steel. The outer and inner pipes 102 and 103 are connected to each other at their ends opposite to the bottoms, i.e., at the upper ends. As a result, a sealed space 108 is formed between the outer and inner pipes 102 and 103. The sealed space 108 is a depressurized vacuum space, and the outer and inner pipes 102 and 103 are thermally insulated from each other by the sealed space 108, which is a vacuum space. The outside of the outer pipe 102 is the outside air. The space inside the inner pipe 103 serves as a heating space 113. In the bottom of the inner pipe 103, a protrusion 103*a* that extends in the axial direction and into the sealed space 108 is formed.

A reinforcing member 106 is disposed so as to cover an outer circumference of the inner pipe 103. Similarly to the first embodiment, the expression that the reinforcing member 106 "covers the outer circumference of the inner pipe 103" is not used to limit its meaning to the case where the reinforcing member 106 completely covers the outer circumference of the inner pipe 103. It includes the case where a part of the outer circumference of the inner pipe 103 is exposed from the reinforcing member 106. The reinforcing member 106 has a tubular shape and is formed of a material having a higher heat resistance and a higher strength than those of the material of the inner pipe 103. The reinforcing member 106 is formed of, for example, a material containing graphite, a carbon fiber reinforced carbon composite material (a C/C composite), or a material containing alumina. A through hole 106*a* is formed in the bottom of the reinforcing member 106. The protrusion 103*a* is inserted through the through hole 106*a* of the reinforcing member 106. Further, a washer 111 and a split pin 112 are attached to the tip of the protrusion 103*a* which has passed through the through hole 106*a*. In this way, the reinforcing member 106 is connected to the inner pipe 103 at their bottoms.

When the inner pipe 103 of the double insulating wall structure heating furnace 101 is heated to a high heating temperature of about 1,000° C., it thermally expands in the radial and axial directions and softens. Therefore, its strength decreases. Since the tubular reinforcing member 106, which is formed of a material having a higher heat resistance and a higher strength than those of the material of the inner pipe 103, is disposed so as to cover the outer circumference of the inner pipe 103, the inner pipe 103, which is heated to a high temperature and hence has a reduced strength, is well reinforced by the reinforcing member 106.

Next, states of the double insulating wall structure heating furnace 101 according to this embodiment before and after heating in the heating space 113 is carried out are described.

Figure 6:
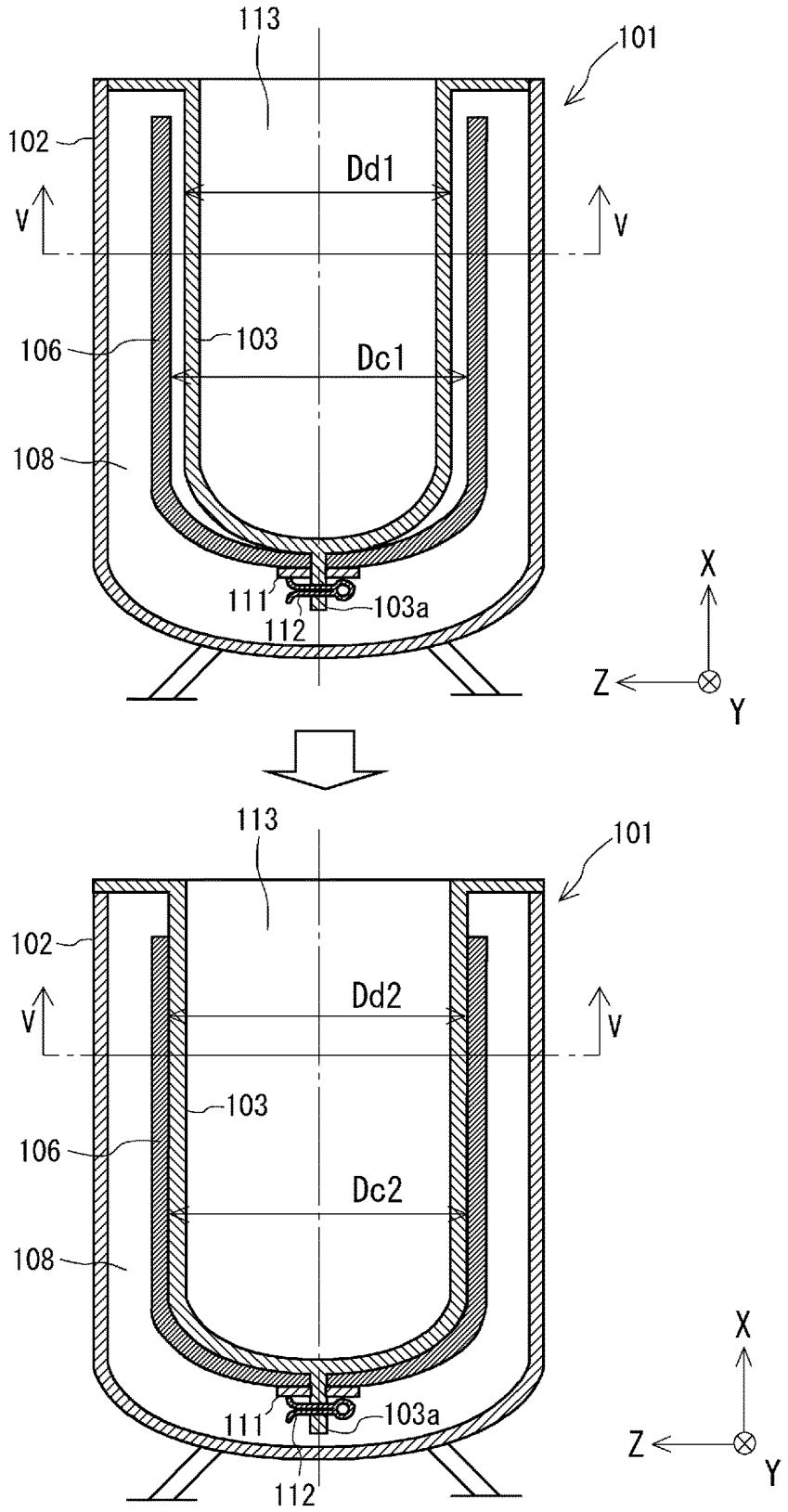
FIG. 6 is a schematic diagram for explaining states of a double insulating wall structure heating furnace according to a second embodiment before and after heating in a heating space is carried out.
Figure 7:
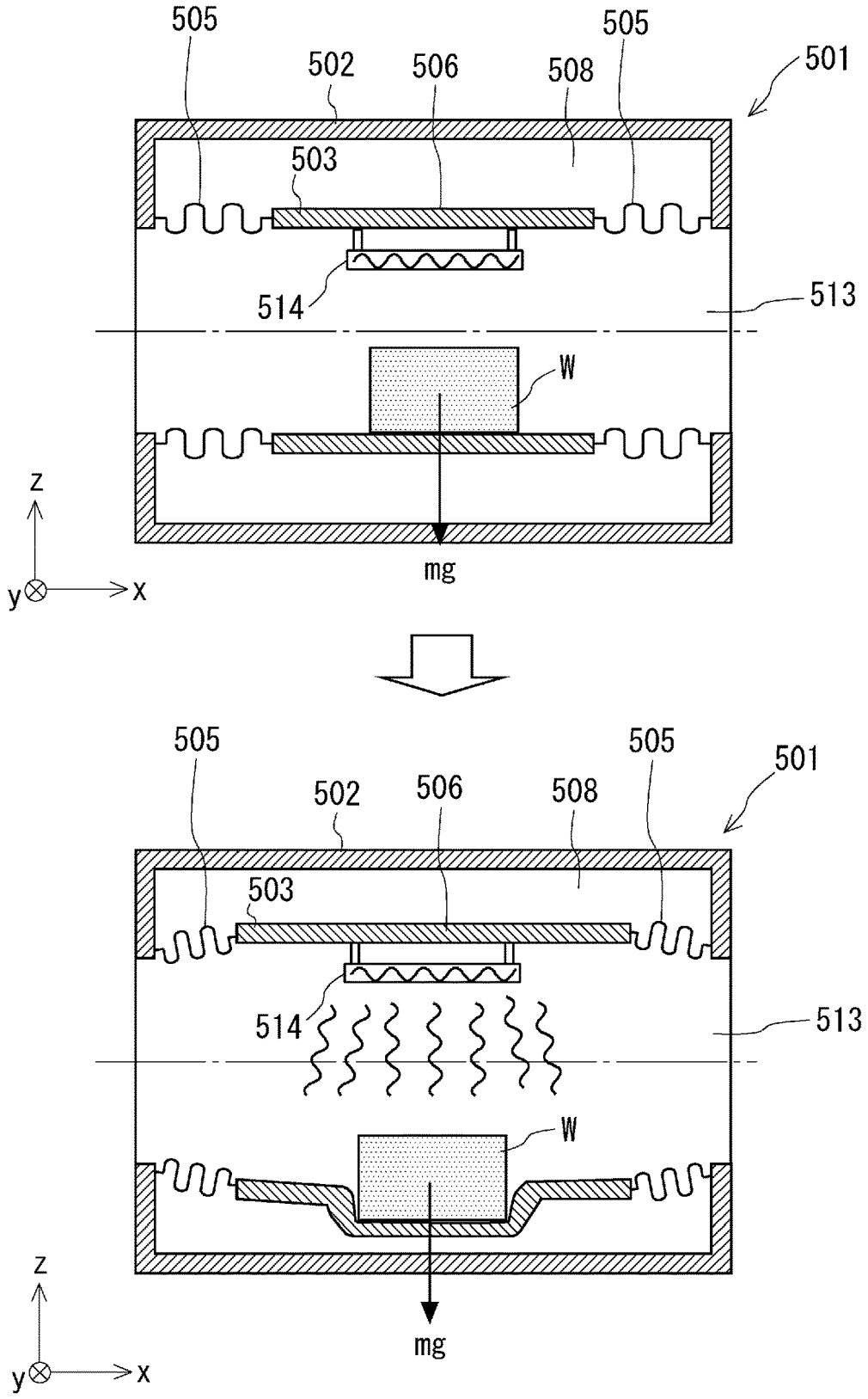
FIG. 7 is a schematic cross section for explaining a double insulating wall structure heating furnace related to a problem to be solved by the present disclosure.

FIG. 6 is a schematic diagram for explaining states of the double insulating wall structure heating furnace 101 before and after heating in the heating space 113 is carried out. An upper part of FIG. 6 shows the double insulating wall structure heating furnace 101 in an unheated state, and a lower part thereof shows that in a heated state.

As shown in the upper part of FIG. 6, the reinforcing member 106 of the double insulating wall structure heating furnace 101 is configured so that its inner diameter Dc1 is larger than an outer diameter Dd1 of the inner pipe 103 in the unheated state. Further, as shown in the lower part of FIG. 6, the reinforcing member 106 of the double-walled insulating wall structure heating furnace 101 is configured so that its inner diameter Dc2 becomes substantially equal to an outer diameter Dd2 of the inner pipe 103 at the heating temperature.

The coefficient of thermal expansion of the inner pipe 103 is larger than that of the reinforcing member 106. That is, a difference between the outer diameter Dd2 of the inner pipe 103 in the heated state and the outer diameter Dd1 of the inner pipe 103 in the unheated state is larger than a difference between the inner diameter Dc2 of the reinforcing member 106 in the heated state and the inner diameter Dc1 of the reinforcing member 106 in the unheated state. By configuring the reinforcing member 106 so that its inner diameter is larger than the outer diameter of the inner pipe 103 in the unheated state and its inner diameter is substantially equal to the outer diameter of the inner pipe 103 at the heating temperature, the inner pipe 103, whose strength has decreased due to the high-temperature heating, is well reinforced by the reinforcing member 106 without being warped.

As described above, according to the double insulating wall structure heating furnace 101 in accordance with this embodiment, it is possible to prevent the inner pipe 103, whose strength has decreased due to high-temperature heating, from being damaged.

It should be noted that the present disclosure is not limited to the above-described embodiments and can be modified as appropriate without departing from the scope and spirit of the present disclosure.

In the above-described embodiments, the reinforcing member is preferably formed of an inexpensive material containing graphite. When a material containing graphite is heated to a high heating temperature of about 1,000° C. in a state in which the material is exposed to the outside air, the graphite reacts with oxygen in the atmosphere and becomes carbon dioxide. As a result, the graphite disappears. However, in the double insulating wall structure heating furnace according to the above-described embodiment, the reinforcing member is disposed in the sealed space, which is a vacuum space. Therefore, even in the case where the reinforcing member is formed of a material containing graphite, the graphite does not disappear even when the reinforcing member is heated to a high temperature of about 1,000° C.

In the above-described embodiments, in the case where the reinforcing member is made of a material containing graphite or a carbon-containing material such as a carbon fiber reinforced carbon composite material, a ceramic thin film is preferably inserted between the outer circumferential surface of the inner pipe and the inner circumferential surface of the reinforcing member. By doing so, it is possible to prevent the metallic inner pipe and the reinforcing member from coming into contact with each other and thereby prevent the metallic inner pipe from being carburized during the high-temperature heating.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A double insulating wall structure heating furnace comprising:

an outer pipe and an inner pipe disposed inside the outer pipe, in which a vacuum sealed space is provided between the outer and inner pipes and a heating space is provided inside the inner pipe which is heated to a heating temperature during use of the heating furnace, and a tubular reinforcing member is disposed in the vacuum sealed space so as to cover an outer circumference of the inner pipe, the tubular reinforcing member being formed of a material that has a higher strength than that of a material of the inner pipe at the heating temperature, wherein the reinforcing member is configured so that its inner diameter is larger than an outer diameter of the inner pipe in an unheated state and its inner diameter is substantially equal to the outer diameter of the inner pipe at the heating temperature.

2. The double insulating wall structure heating furnace according to claim 1, wherein the material of the reinforcing member contains graphite.

3. The double insulating wall structure heating furnace according to claim 2, wherein a thin film made of ceramic is provided between the inner pipe and the reinforcing member.

* * * * *